US006882733B2

(12) United States Patent
Sato

(10) Patent No.: US 6,882,733 B2
(45) Date of Patent: Apr. 19, 2005

(54) SURROUND HEADPHONE OUTPUT SIGNAL GENERATOR

(75) Inventor: Koichi Sato, Yamagata-ken (JP)

(73) Assignee: Pioneer Corporation, Tokyo (JP)

( * ) Notice: Subject to any disclaimer, the term of this patent is extended or adjusted under 35 U.S.C. 154(b) by 180 days.

(21) Appl. No.: 10/420,709

(22) Filed: Apr. 23, 2003

(65) Prior Publication Data

US 2003/0210795 A1 Nov. 13, 2003

(30) Foreign Application Priority Data

May 10, 2002 (JP) ..... 2002-135862

(51) Int. Cl.[7] ..... H04R 1/10
(52) U.S. Cl. ..... 381/74; 700/94; 381/309
(58) Field of Search ..... 381/74, 119, 19–22, 381/309; 700/94

(56) References Cited

U.S. PATENT DOCUMENTS 5,661,812 A * 8/1997 Scofield et al. ..... 381/74
6,215,737 B1 * 4/2001 Thagard et al. ..... 369/4

* cited by examiner

*Primary Examiner*—Ping Lee
(74) *Attorney, Agent, or Firm*—Arent Fox

(57) ABSTRACT

In a surround headphone output signal generator for generating multichannel sound signals from digital audio data, and combining the sound signals for the respective channels to generate two-channel surround headphone output signals for outputting to headphones, a DIR 10 detects from the digital audio data a sampling frequency (FS) included in the digital audio data concerned. A microcomputer 13 selects an attenuation coefficient α1 or α2 in accordance with the sampling frequency (FS) detected by the DIR 10, and attenuates the levels of surround headphone output signals Lo and Ro on the basis of the selected attenuation coefficient α1 or α2.

5 Claims, 2 Drawing Sheets

SURROUND HEADPHONE OUTPUT SIGNAL GENERATOR

BACKGROUND OF THE INVENTION

1. Field of the Invention

This invention relates to a surround headphone output signal generator for use in multichannel reproducing apparatus to combine multichannel signals into two-channel signals and output the two-channel signals to headphones.

The present application claims priority from Japanese Application No. 2002-135862, the disclosure of which is incorporated herein by reference.

2. Description of the Related Art

Multichannel reproducing apparatus such as that in an A/V amplifier, a DVD player and the like typically generates source (sound) signals for right and left front channels, a center channel, right and front surround channels, and additionally a subwoofer channel, from digital audio data stored on a DVD (Digital Versatile Disc), a CD (Compact Disc) or the like recorded through multiple channels, and outputs the generated signals to five or more speakers placed around the listener, in order to form a sound field in three-dimensional sound which gives the listeners the feeling of being at a live performance or a theater.

Listening to the three-dimensional sound, reproduced by the multichannel reproducing apparatus, through headphones requires combining the source signals for the respective channels generated from the digital audio data to re-generate source signals for the two channels.

Such combining of the multichannel source signals into the two-channel source signals is referred to as stereo-downmixing.

FIG. 2 is a block diagram illustrating the conventional configuration for executing stereo-downmixing in the multichannel reproducing apparatus incorporating headphone terminals.

In FIG. 2, a digital-audio interface receiver (hereinafter referred to as "DIR") 1 receives the input of two-channel digital audio data which is transmitted from digital audio equipment of various types into the multichannel reproducing apparatus.

The DIR 1 carries out demodulation to extract a clock and data from the incoming digital audio data, and then outputs the resulting clock (CK) and data (DATA) to a multichannel decoder 2.

Then, the multichannel decoder 2 generates channel signals (5.1 channel in this case) consisting of a left front signal L, a right front signal R, a center signal C, a left surround signal LS, a right surround signal RS and a sub-woofer signal LFE, from the data (DATA) supplied from the DIR 1 in accordance with the associated clock (CK), and then outputs the resulting signals to the stereo-downmixing processor 3.

The stereo-downmixing processor 3 combines the left front signal L, the right front signal R, the center signal C, the left surround signal LS, the right surround signal RS and the sub-woofer signal LFE on the basis of preset downmixing coefficients, to produce two-channel surround headphone output signals Lo and Ro for outputting to the headphones.

The following is the mathematical expressions of representing an example of the combining process for the stereo-downmixing signals in the stereo-downmixing processor 3:

$$Lo=L+0.707C+LS+LFE$$

$$Ro=R+0.707C+RS+LFE$$

As seen from the mathematical expression, in the process of combining into the surround headphone output signals Lo and Ro, if the source signals for the respective channels to be combined are concurrently increased in level, the gain to the surround headphone output signals Lo and Ro may exceed one (zero dB), which causes clipping in the sound reproduced from the headphones.

For this reason, in order to prevent clipping in the sound reproduced from the headphones, the prior art performs a multiplication by an attenuation coefficient $\alpha$ in the process of combining into the surround headphone output signals Lo and Ro as follows:

$$Lo=\alpha\ (L+0.707C+LS+LFE)$$

$$Ro=\alpha\ (R+0.707C+RS+LFE).$$

The attenuation coefficient $\alpha$ is determined taking into consideration a degree of margin and risk because a small value given to the attenuation coefficient $\alpha$ (i.e. a high attenuation rate) reduces each level of the surround headphone output signals Lo and Ro so as to result in a decline in an S/N ratio, whereas a large value (i.e. a low attenuation rate) makes it impossible to prevent clipping in the sound reproduced by the surround headphone output signals Lo and Ro.

However, the balance between the recording levels of the respective channels in the multichannel source varies among the types of multichannel sources.

For example, in the case of a movie source such as a DVD and the like, the LFE channel or the surround channel is increased in level, or alternatively all channels are increased in level in an instant for the purpose of producing dramatic sound effects. In the case of a music source such as a CD, an audio DVD and the like, the front channels (L, C and R) have a high level because the sound of the instruments played or the vocal performed on the stage is concentrated at the front, but the surround channel for reproducing reflected sound or sound generated from the audience for the purpose of creating the atmosphere in a concert hall or the like has a relative low level, and the LFE channel is less used.

For these reasons, conventionally, there are some problems: even if an attenuation a is set at any of the values in the stereo-downmixing process, it is impossible to completely prevent clipping in the sound reproduced from the surround headphone output signals Lo and Ro in the case of a movie source, and to prevent a decline in the S/N ratio in the case of a music source.

SUMMARY OF THE INVENTION

The present invention has been made to solve the problems associated with the prior art multichannel reproducing apparatus as described above.

It is therefore an object of the present invention to provide a surround headphone output signal generator capable of generating an optimum surround headphone output signal in accordance with the type of multichannel source in multichannel reproducing apparatus.

To attain the object, a surround headphone output signal generator according to a first feature of the present invention is for generating multichannel sound signals from digital audio data, and combining the sound signals for the respective channels to generate two-channel surround headphone output signals for outputting to headphones, and includes: a sampling frequency detection member detecting from the digital audio data a sampling frequency included in the digital audio data concerned; and an attenuation rate control member selecting an attenuation rate in accordance with the sampling frequency detected by the sampling frequency detection member, and attenuating a level of the surround headphone output signal on the basis of the selected attenuation rate.

The surround headphone output signal generator according to the first feature provided in a multichannel reproducing apparatus such as that in an A/V amplifier, a DVD player or the like, generates channel sound signals from digital audio data read out from a DVD, a CD or the like, and then combines (i.e. mixes down) the channel sound signals into two channel surround headphone output signals to be outputted to the headphones. In this process, the sampling frequency detection member detects the sampling frequency included in the incoming digital audio data, and supplies information about the detected sampling frequency to the attenuation rate control member.

Based on the information about the sampling frequency supplied from the sampling frequency detection member, the attenuation rate control member selects an attenuation rate for attenuating the output level of the surround headphone output signal, for each sampling frequency indicated in the information.

The selection of an attenuation rate may be carried out by means of presetting an attenuation coefficient indicating the attenuation rate for each standard sampling frequency.

After the selection, the attenuation rate control member attenuates the levels of each of the two-channel surround headphone output signals combined in a DSP (Digital Signal Processor) such as a stereo-downmixing processor or the like, on the basis of the selected attenuation rate.

As described above, according to the first feature, the present invention allows the generation of the optimum surround headphone output signal in accordance with each sound source because the attenuation rate for the level of each of the surround headphone output signals to be outputted to the headphones is determined in accordance with the type of multichannel sound source.

To attain the aforementioned object, in the surround headphone output signal generator according to a second feature of the present invention, in addition to the configuration of the first feature, the sampling frequency detection member is a digital audio interface receiver detecting a clock and data from the digital audio data.

With the surround headphone output signal generator according to the second feature, when the digital interface receiver serving as the sampling frequency detection member performs demodulation to extract a clock and data from the digital audio data, the digital interface receiver detects a sampling frequency included in the digital audio data, and supplies information about the detected sampling frequency to the attenuation rate control member.

To attain the aforementioned object, in the surround headphone output signal generator according to a third feature of the present invention, in addition to the configuration of the first feature, the attenuation rate control member selects an attenuation rate between an attenuation rate in accordance with the sampling frequency indicating a movie sound source, and an attenuation rate in accordance with the sampling frequency indicating a music sound source.

With the surround headphone output signal generator according to the third feature, the attenuation rate control member determines, on the basis of the information about the sampling frequency of the digital audio data supplied from the sampling frequency detection member, whether the multichannel sound source providing the digital audio data is a movie source, such as a movie or the like, or a music source, such as a musical performance or the like. Then, the attenuation rate control member selects the attenuation rate suitable for the level of the surround headphone output signal to be outputted to the headphone, and then attenuates the level of the surround headphone output signal concerned on the basis of the selected attenuation rate.

This design allows the generation of a surround headphone output signal having an optimum level in accordance with either the movie sound source or the music sound source.

To attain the aforementioned object, in the surround headphone output signal generator according to a fourth feature of the present invention, in addition to the configuration of the third feature, the attenuation rate selected by the attenuation rate control member when the sampling frequency indicating the movie sound source is detected, is higher than the attenuation rate selected by the attenuation rate control member when the sampling frequency indicating the music sound source is detected.

With the surround headphone output signal generator according to the fourth feature, the attenuation rate control member selects a higher attenuation rate for a level of the surround headphone output signal when it is determined from the detection of the sampling frequency that the sound source of the digital audio data is a movie sound source, and a lower attenuation rate for a level of the surround headphone output signal when it is determined that the sound source is a music sound source.

In the case of the digital audio data from a movie sound source such as a DVD or the like, in some cases, the subwoofer channel and/or the surround channel is increased in level, or alternatively all channels are increased in level in an instant, for the purpose of producing dramatic sound effects. In such an event, the attenuation rate for the level of the surround headphone output signal is set higher, thereby preventing clipping in the sound reproduced from the headphones.

In the case of the digital audio data from a music sound source such as a CD, an audio DVD and the like, the front channels have a high level because the sound of the instruments played or the vocal performed on the stage is concentrated at the front, but the surround channels for reproducing reflected sound or sound generated from the audience for the purpose of creating the atmosphere in a concert hall or the like is relatively low in level, and the LFE channel is less used. However, the setting of a low attenuation rate for the level of the surround headphone output signal, prevents the sound reproduced from the headphones from declining in the S/N ratio.

To attain the aforementioned object, in the surround headphone output signal generator according to a fifth feature of the present invention, in addition to the configuration of the fourth feature, an attenuation coefficient determining the attenuation rate when the sampling frequency indicating the movie sound source is detected is 0.35, and an attenuation coefficient determining the attenuation rate when the sampling frequency indicating the music sound source is detected is 0.5.

With the surround headphone output signal generator according to the fifth feature, when the digital audio data comes from the movie sound source, the attenuation rate control member sets the attenuation rate at 0.35 to greatly attenuate the level of each surround headphone output signal to be outputted to the headphones, thus preventing clipping in the sound reproduced from the headphones.

On the other hand, when the digital audio data comes from the music sound source, the attenuation rate control member sets the attenuation rate at 0.5 to attenuate the level of each surround headphone output signal to be outputted to the headphones to a lower degree than that in the case of the movie sound source. Hence, the reproduced sound from the headphones is prevented from declining in the S/N ratio due to the attenuation in level of the surround output signal.

These and other objects and advantages of the present invention will become obvious to those skilled in the art upon review of the following description, the accompanying drawings and appended claims.

DETAILED DESCRIPTION OF THE PREFERRED EMBODIMENT

A preferred embodiment according to present invention will be described below in detail with reference to the accompanying drawings.

Figure 1:
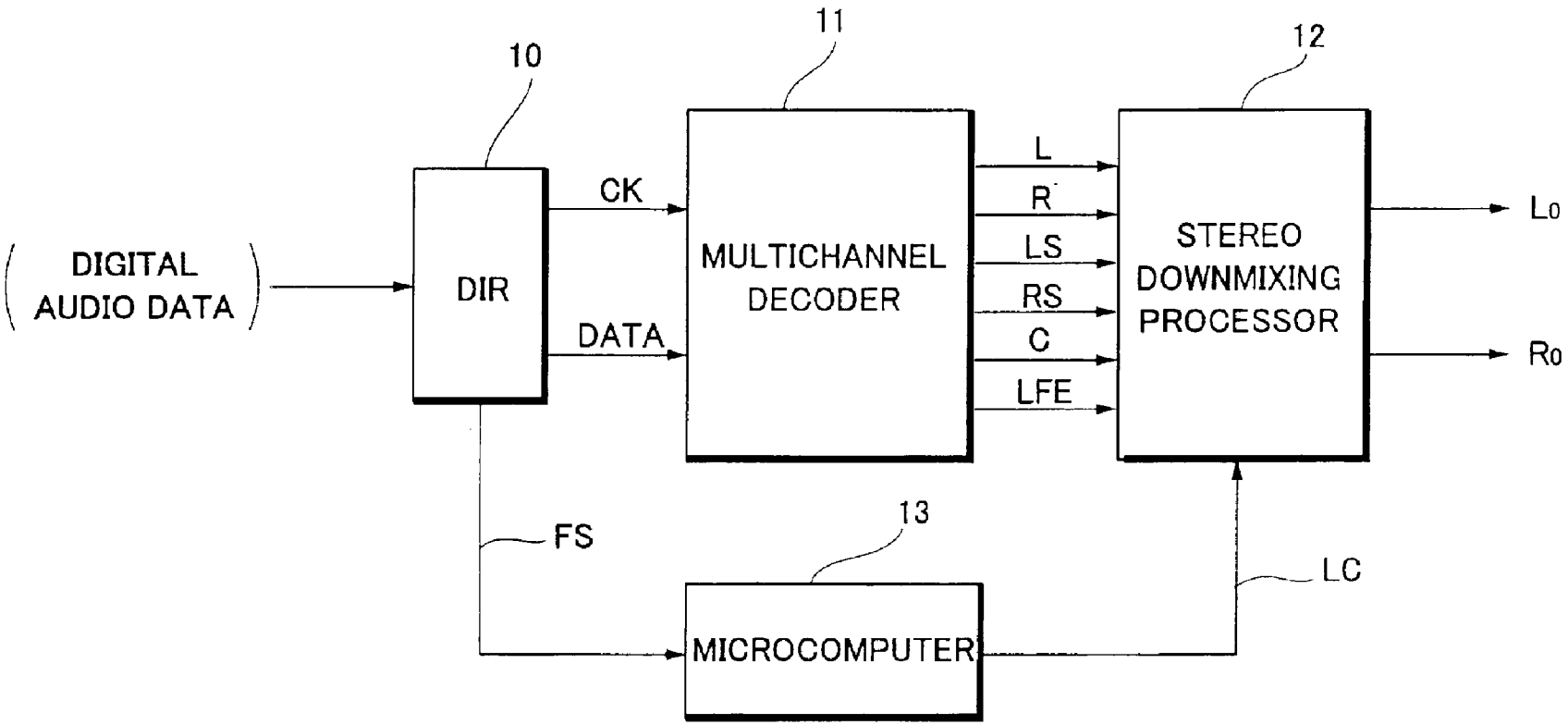
FIG. 1 is a block diagram illustrating an embodiment according to the present invention.

FIG. 1 is a block diagram illustrating the configuration of a surround headphone output signal generator of the embodiment according to the present invention.

Referring to FIG. 1, the surround headphone output signal generator includes a DIR 10, a multichannel decoder 11 and a stereo-downmixing processor 12, and also a microcomputer 13 connected to the DIR 10 and the stereo-downmixing processor 12.

As described later, the microcomputer 13 acquires, from the DIR 10, information about the sampling frequency (FS) included in digital audio data, and determines, on the basis of the acquired information about the sampling frequency, an attenuation rate for reducing the level of an output signal which results from the stereophonic downmixing in the stereo-downmixing processor 12 to be outputted to the headphones.

Specifically, when the DIR 10 detects a clock (CK) and data (DATA) from the incoming digital audio data, the DIR 10 detects information about the sampling frequency (FS) included in the digital audio data concerned, and then outputs a detection signal FS, representing the detected sampling frequency, to the microcomputer 13.

The microcomputer 13 stores the respective attenuation coefficients of the levels of signals to be outputted to the headphones, in accordance with the sampling frequencies.

Figure 2:
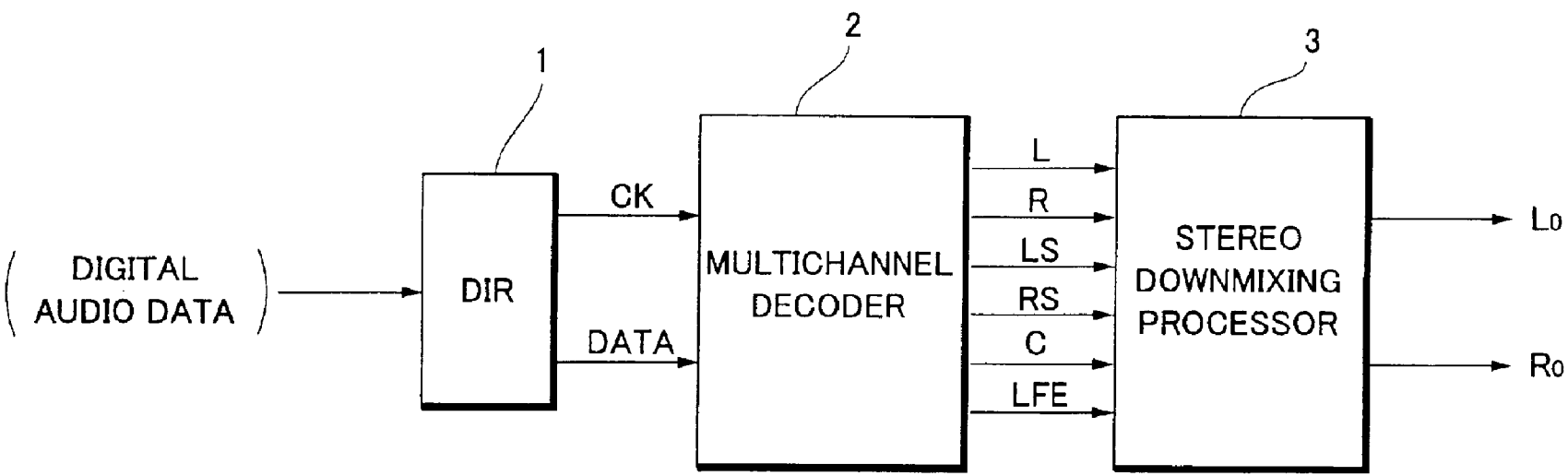
FIG.2 PRIOR ART
FIG. 2 is a block diagram illustrating an example of the prior art.

One specific example is given in the case of the combining expressions for the stereo-downmixing signals which are used in the description in FIG. 2:

$$Lo=\alpha\ (L+0.707C+LS+LFE)$$

$$Ro=\alpha\ (R+0.707C+RS+LFE).$$

When a sampling frequency (FS) is FS=48 kHz which indicates that the multichannel source is a movie source such as a DVD or the like, the microcomputer 13 sets an attenuation coefficient of $\alpha=\alpha1$. When the sampling frequency (FS) is FS=44.1 kHz which indicates that the multichannel source is a music source such as a CD, an audio DVD or the like, the microcomputer 13 sets an attenuation coefficient of $\alpha=\alpha2$.

Upon reception of the FS signal from the DIR 10, the microcomputer 13 determines on the basis of the received FS signal whether the sampling frequency is 48 kHz or 44.1 kHz.

Then, the microcomputer 13 outputs to the stereo-downmixing processor 12 an output level control signal LC representative of the attenuation coefficient $\alpha1$ or $\alpha2$ preset in accordance with the determined sampling frequency. On the basis of this output, the stereo-downmixing processor 12 performs a multiplication by the attenuation coefficient $\alpha1$ or $\alpha2$ in the stereo-downmixing process, to generate surround headphone output signals Lo and Ro having output levels corresponding to the type of multichannel source to be reproduced.

In other words, when the multichannel source is a movie source such as a DVD or the like (i.e. in the case of FS=48 kHz), the stereo-downmixing processor 12 generates the surround headphone output signals Lo and Ro on the basis of the expressions:

$$Lo=\alpha1\ (L+0.707C+LS+LFE)$$

$$Ro=\alpha1\ (R+0.707C+RS+LFE).$$

When the multichannel source is a music source such as a CD, an audio DVD or the like (i.e. in the case of FS=44.1 kHz), the stereo-downmixing processor 12 generates the surround headphone output signals Lo and Ro on the basis of the expressions:

$$Lo=\alpha2\ (L+0.707C+LS+LFE)$$

$$Ro=\alpha2\ (R+0.707C+RS+LFE).$$

In the above expressions, attenuation coefficients are set to be $\alpha1$ (FS=48 kHz)$<\alpha$ 2 (FS=44.1 kHz).

In the case of a movie source, setting a high attenuation rate for the level of each of the surround headphone output signals Lo and Ro prevents the sound reproduced from the headphones from clipping. In the case of a music source, an attenuation rate for the level of each of the surround headphone output signals Lo and Ro is set lower than that in the movie source, thereby preventing a decline in the S/N ratio of the sound reproduced from the headphones.

At this point, in the case of the music source, the majority of the output energy of the music source is concentrated in the front channel, and the output energy in the surround channels is small, or alternatively the LFE channel is not included. Hence, even with a low attenuation rate set for a level of each of the surround headphone output signals Lo and Ro, there is no likelihood of clipping in the sound reproduced from the headphone.

The following is another example of expressions of the combining process for the surround headphone output signals Lo and Ro.

$$Lo=\beta\ (L+0.71C+0.71LS+0.5LFE)$$

$$Ro=\beta\ (R+0.71C+0.71RS+0.5LFE)$$

In this example, an attenuation coefficient of $\beta=\beta1$ when the multichannel source is the movie source (FS=48 kHz), and an attenuation coefficient of $\beta=\beta2$ when the multichannel source is the music source (FS=44.1 kHz) are set in the proportion $\beta1<\beta2$, for example $\beta1=0.5$ and $\beta2=0.35$, so that in the case of a movie source clipping in the sound reproduced from the headphones is prevented, and in the case of a music source the sound reproduced from the headphones is prevented from declining in the S/N ratio.

As described above, with the surround headphone output signal generator, the level of each of the surround headphone output signals Lo and Ro to be outputted to the headphones is automatically controlled in accordance with the type of multichannel source. This level control makes it possible to generate the optimum surround headphone output signals Lo and Ro in accordance with each type of multichannel source to be reproduced.

The embodiment describes the case of setting two attenuation coefficients for the two types of multichannel source, the movie source and the music source. However, if the sampling frequencies of three or more types of multichannel sources are standardized, three or more attenuation coefficients in accordance with the respective sampling frequencies are set.

The embodiment takes the example that the multichannel includes the LFE channel, but when the multichannel does not include the LFE channel, the attenuation coefficients are set as in the case of the embodiment.

The terms and description used herein are set forth by way of illustration only and are not meant as limitations. Those skilled in the art will recognize that numerous variations are possible within the spirit and scope of the invention as defined in the following claims.

What is claimed is:

1. A surround headphone output signal generator for generating multichannel sound signals from digital audio data, and combining the sound signal for the respective channels to generate two-channel surround headphone output signals for outputting to headphones, comprising:

a sampling frequency detection member detecting from said digital audio data a sampling frequency included in the digital audio data concerned; and an attenuation rate control member selecting an attenuation rate in accordance with the sampling frequency detected by the sampling frequency detection member, and attenuating a level of said surround headphone output signal on the basis of the selected attenuation rate.

2. A surround head phone output signal generator according to claim 1, wherein said sampling frequency detection member is a digital audio interface receiver detecting a clock and data from said digital audio data.

3. A surround head phone output signal generator according to claim 1, wherein said attenuation rate control member selects an attenuation rate between an attenuation rate in accordance with the sampling frequency indicating a movie, sound source, and an attenuation rate in accordance with the sampling frequency indicating a music sound source.

4. A surround head phone output signal generator according to claim 3, wherein the attenuation rate selected by said attenuation rate control member when the sampling frequency indicating the movie sound source is detected, is higher than the attenuation rate selected by said attenuation rate control member when the sampling frequency indicating the music sound source is detected.

5. A surround head phone output signal generator according to claim 4, wherein an attenuation coefficient determining said attenuation rate when the sampling frequency indicating the movie sound source is detected is 0.35, and an attenuation coefficient determining said attenuation rate when the sampling frequency indicating the music sound source is detected is 0.5.

* * * * *